US005354248A

United States Patent [19]

Rawls et al.

[11] Patent Number: 5,354,248

[45] Date of Patent: Oct. 11, 1994

[54] EXERCISE APPARATUS

[75] Inventors: R. Lee Rawls, Woodinville; James A. Duncan, Renton, both of Wash.

[73] Assignee: Stairmaster Sports/Medical Products, Inc., Kirkland, Wash.

[21] Appl. No.: 33,870

[22] Filed: Mar. 19, 1993

[51] Int. Cl.[5] ..... A63B 23/04

[52] U.S. Cl. ..... 482/6; 482/52; 482/99

[58] Field of Search ..... 482/1-9, 482/51-53, 63-65, 97-103, 133-138, 900, 901, 902, 908

[56] References Cited

U.S. PATENT DOCUMENTS

| | | | |
|---|---|---|---|
| 3,445,108 | 5/1969 | Fenner et al. . | |
| 3,599,974 | 8/1971 | Price . | |
| 3,782,718 | 1/1974 | Saylor . | |
| 3,794,316 | 2/1974 | Toman . | |
| 4,082,267 | 4/1978 | Flavell . | |
| 4,199,139 | 4/1980 | Mahnke et al. . | |
| 4,512,570 | 4/1985 | Tardivel . | |
| 4,708,338 | 11/1987 | Potts . | |
| 4,709,919 | 12/1987 | Cano . | |
| 4,775,146 | 10/1988 | Stankovic . | |
| 4,822,032 | 4/1989 | Whitmore et al. | 482/6 X |
| 4,822,036 | 4/1989 | Dang | 482/6 |
| 4,842,268 | 6/1989 | Jenkins . | |
| 4,921,244 | 5/1990 | Berroth . | |
| 4,938,474 | 7/1990 | Sweeney et al. | 482/52 |
| 4,941,652 | 7/1990 | Nagano et al. | 482/6 |
| 5,015,926 | 5/1991 | Casler | 482/6 X |
| 5,060,938 | 10/1991 | Hawley, Jr. . | |
| 5,135,447 | 8/1992 | Robards, Jr. et al. | 482/6 X |
| 5,180,351 | 1/1993 | Ehrenfried | 482/52 |

FOREIGN PATENT DOCUMENTS

| | | |
|---|---|---|
| 52-23423 | 2/1977 | Japan . |
| 1204219 | 2/1969 | U.S.S.R. . |

*Primary Examiner*—Robert Bahr
*Attorney, Agent, or Firm*—Seed & Berry

[57] ABSTRACT

An exercise apparatus having a vertically movable weight, and an input pedal mechanism engaged by the user to input an input power with a unidirectional exercise force at a user-selected velocity for moving the weight upward. Also included is a brake applying a negative braking power with a unidirectional braking force opposing the exercise force. The braking power has a braking velocity for permitting downward movement of the weight. A brake controller controls the application of the brake to maintain the braking velocity at a selected constant velocity for at least a selected portion of the user's exercise time. A differential member is coupled to the weight and receives the input power and the braking power. The differential member determines a differential between the user-selected velocity and the selected constant braking velocity, and applies the resultant to movement of the weight. If the user-selected velocity is greater than the braking velocity, the weight is lifted, and if the user-selected velocity is less than the selected constant braking velocity, the weight is lowered. If they match, the weight is maintained in a stationary elevated position.

70 Claims, 5 Drawing Sheets

EXERCISE APPARATUS

TECHNICAL FIELD

The present invention relates generally to exercise apparatus, and more particularly, to a machine which facilitates exercise using a controlled exercise force and speed.

BACKGROUND OF THE INVENTION

Exercise machines of various designs exist to improve muscle strength and coordination and provide aerobic exercise. It has long been desired to provide an exercise machine that is able to fully and independently control both velocity and load. A machine capable of producing controlled load exercise provides a constant resistance force against which the user exercises through a desired range of motion, independent of the velocity of the movement. A controlled velocity exercise machine provides a constant speed through the desired range of motion, independent of the force applied. It is desirable to have an exercise machine that allows both controlled load and controlled velocity exercise.

The present invention fulfills these needs, and provides other related advantages.

SUMMARY OF THE INVENTION

The present invention resides in an exercise apparatus for a human user. The apparatus includes a vertically movable weight or an alternative form of a resistance member which applies a resistance force. The apparatus also includes an input mechanism engaged by the user to input a positive input power with a unidirectional exercise force at a user-selected velocity for moving the weight upward. A speed control such as a brake is provided to apply a negative braking power with a unidirectional braking force opposing the exercise force, the braking power having a braking velocity for permitting downward movement of the weight. A brake controller controls the application of the brake to maintain the braking velocity at a selected constant velocity for at least a selected portion of the user's exercise time.

A differential member is coupled to the weight and receives the input power from the input mechanism and the braking power from the brake. The differential member determines a differential between the user-selected velocity and the selected constant braking velocity, and applies the resultant to the weight so that if the user-selected velocity is greater than the selected constant braking velocity the weight is lifted, and if the user-selected velocity is less than the selected constant braking velocity the weight is lowered. As such, the user during at least the selected portion of the user's exercise time can apply input power to lift the weight to a desired elevation and maintain the weight at about the desired elevation by applying input power with the user-selected velocity substantially matching the selected constant braking velocity.

In the illustrated embodiment of the invention, the apparatus includes a flexible member interconnecting the input mechanism, the brake and the differential member to transmit the input power and the braking power to the differential member. The differential member includes a movable trolley with the weight coupled thereto so that movement of the trolley in a first direction lifts the weight and movement of the trolley in a second direction lowers the weight. The trolley is supported by the flexible member to produce movement of the trolley in the first direction if the user-selected velocity is greater than the selected constant braking velocity, and to produce movement of the trolley in the second direction if the user-selected velocity is less than the selected constant braking velocity.

The flexible member is in the form of an endless loop operatively engaged by the brake to transmit the braking power thereto and by the input mechanism to transmit the input power thereto. The flexible member includes a first length extending between the brake and the input mechanism with the trolley suspended on the first length. The trolley includes a first idler riding on the flexible member and by which the trolley is suspended on the first length. The trolley also includes a second idler over which a return second length of the flexible member extends. The second length extends between the brake and the input mechanism. As such, slack in the endless loop is avoided as the trolley moves between the first and second directions.

In the illustrated embodiment, the apparatus further includes an adjustment member selectively adjustable by the user to select the selected constant braking velocity of the braking power applied by the brake. The selected constant braking velocity is selectively adjustable by the user independent of the mass of the weight.

The weight comprises a stack of individual weights and means for the user to lock selected ones of the individual weights together to form the weight. The adjustment member allows the user to select the selected constant velocity component of the braking power applied by the brake, independent of the number of the individual weights the user selects to lock together.

The selected constant velocity component of the braking power applied by the brake is selectively adjustable during the user's exercise time according to a predetermined pattern. In such manner, the user may vary the selected constant braking velocity during the selected portion of the user's exercise time from the selected constant braking velocity during at least one or more other selected portions of the user's exercise time.

In the illustrated embodiment, the input mechanism includes a pair of pedals operated by the user to input the input power. The flexible member is in the form of an endless loop of chain operatively engaged by the input mechanism and the brake, and operatively engaging the differential member to transmit the input power and the braking power to the differential member. The brake includes an alternator operating in conjunction with a load resister. The rotational speed of the alternator determines the braking velocity of the braking power applied by the brake. The brake controller includes a feedback loop controlling the load applied to the alternator, to control the rotational speed of the alternator.

The brake includes a rotatable brake member around which the flexible member is engaged so that the flexible member is fed to the differential member at a constant feed rate by the rotation of the rotatable brake member during at least the selective portion of the user's exercise time. The input mechanism includes a rotatable input member around which the flexible member is engaged so that the flexible member is drawn away from the differential member at a draw rate determined by the rotational speed of the rotatable input member. The present invention also resides in a novel method of exercising using the exercise apparatus described above.

Other features and advantages of the invention will become apparent from the following detailed description, taken in conjunction with the accompanying drawings.

DETAILED DESCRIPTION OF THE INVENTION

Figure 1:
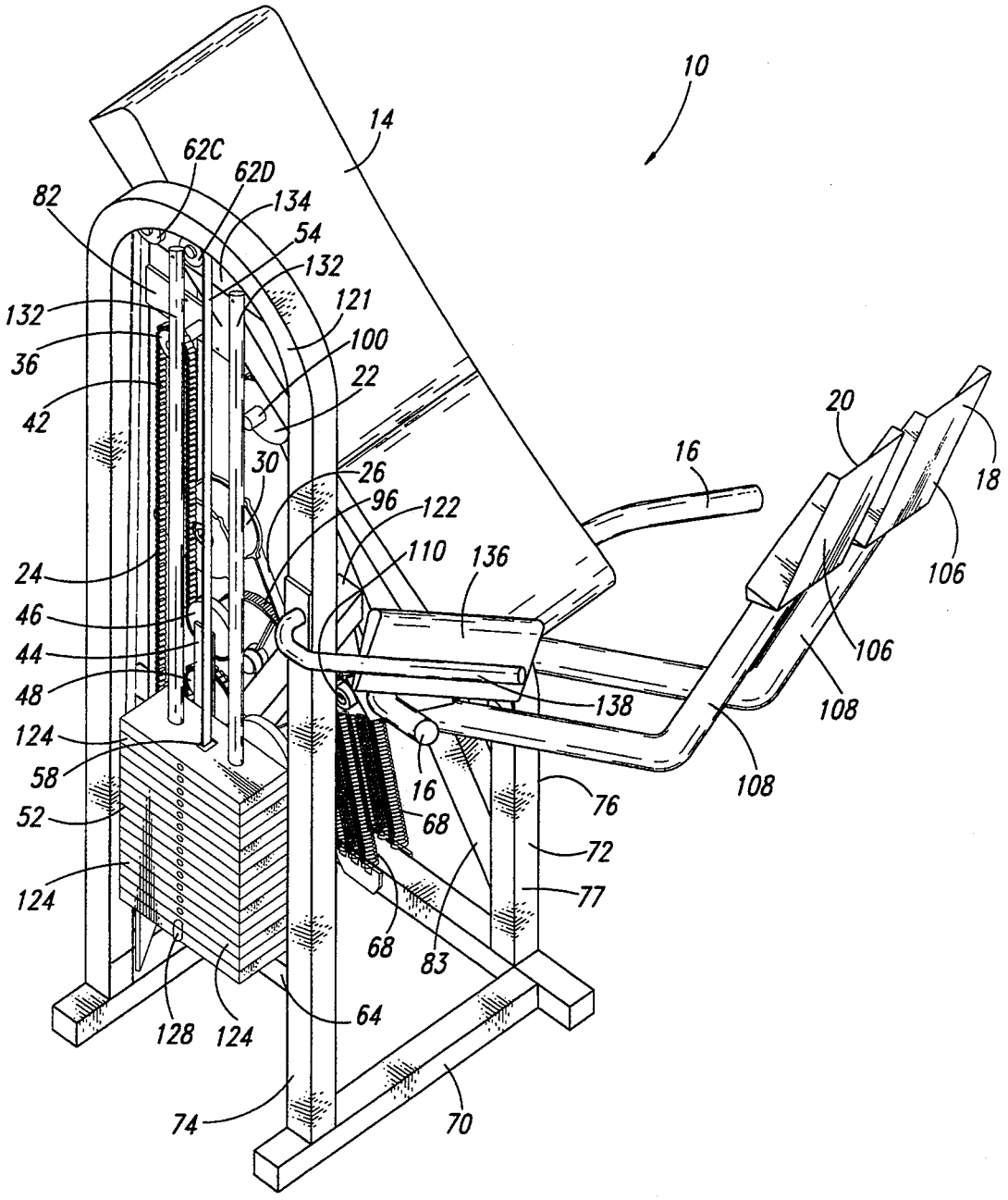
FIG. 1 is a right side isometric view of an exercise apparatus embodying the present invention.

As shown in the drawings for purposes of illustration, the present invention is embodied in an exercise apparatus, indicated generally by the reference numeral 10. The apparatus 10 is shown schematically in the functional block diagram of FIG. 5 as including a resistance force 1, an input mechanism 2, a speed control 3 (which in the illustrated embodiment includes a brake 4 and a brake controller 5), and a differential 6. For purposes of understanding the functional operation of the apparatus 10, the input 2 may be considered as being engaged by a user to input a positive input power having a unidirectional exercise force component determined by the magnitude of the resistance force 1 and a user-selected velocity component indicated by arrow 7. The brake 4 applies a negative braking power with a unidirectional force component determined by the magnitude of the resistance force I and with a braking velocity component indicated by arrow 8 set by the brake controller 5. The braking force component opposes the exercise force component, and the combined exercise force and braking force are in balance with the resistance force.

The brake controller 5 controls the application of the brake 4 to maintain the braking velocity at a selected constant velocity for at least a selected portion of the user's exercise time. The differential 6 is coupled to the resistance force I and receives the input power from the input 2 and the braking power from the brake 4.

As will be described in more detail below, if the resistance force 1 takes the form of a weight, the positive input power applied to the input 2 by the user is for moving the weight upward. Similarly, when the speed control 3 is a brake 4, the application of the negative braking power by the brake permits the downward movement of the weight.

The differential 6 determines a differential between the user-selected velocity component 7 of the input power and the selected constant braking velocity component 8 of the braking power, and applies the resultant to the movement of resistance force I (e.g., the weight if used) so that if the user-selected velocity component is greater than the selected constant braking velocity the weight is lifted, and if the user-selected velocity component is less than the selected constant braking velocity the weight is lowered- As such, the user during at least a selected portion of the user's exercise time can apply input power to lift the weight to a desired elevation and maintain the weight at about the desired elevation by applying input power with the user-selected velocity substantially matching the selected constant braking velocity. Since the combined exercise force and braking force are balanced against the resistance force 1, the exercise is achieved with a controlled, constant load which does not vary during the exercise unless the resistance force 1 is changed by the user. Also, the exercise is achieved with a controlled, constant velocity which does not vary significantly during the exercise unless the selected constant braking velocity is changed by the user since the input velocity is selected by the user in order to match the selected constant braking velocity. Thus, the user during use of the apparatus 10 exercises, for at least a portion of the user's exercise time, using a substantially constant exercise force at a substantially constant speed. The result being a controlled velocity and controlled load exercise.

Figure 6:
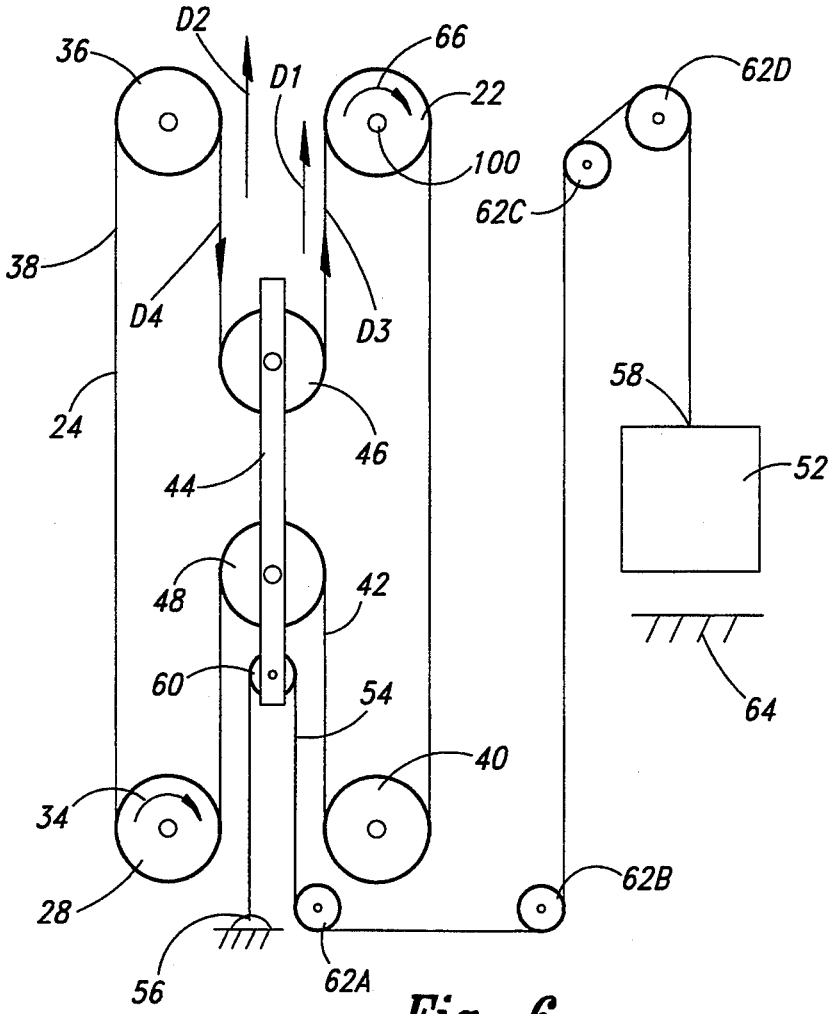
FIG. 6 is a schematic drawing illustrating the operation of the exercise apparatus of FIG. 1.

The presently preferred embodiment of the invention is illustrated in FIGS. 1–4, and schematically in FIG. 6. The exercise apparatus 10 is configured for a human user 12 (see FIG. 3) to exercise by resting with the user's back against a rearwardly inclined, cushioned rest 14. A pair of handles 16 are provided for grasping by the user's hands to help support the user on the rest 14 and assist the user in alternately applying downward force on left and right foot pedals 18 and 20, respectively, using the user's legs. The downward force applied by the user 12 provides the positive input power to the exercise apparatus 10.

As will be described in more detail below, the positive input power applied by the user 12 through the left and right pedals 18 and 20 is transmitted through a unidirectional clutch 21 (see FIG. 4) to an input drive gear 22. The input power is converted to a unidirectional exercise force component applied in the direction indicated by arrow D1 with a user-selected velocity component. While the user selects the input velocity, the apparatus 10 provides a means whereby the user is able to maintain a selected, substantial constant velocity.

An endless loop of chain 24 is entrained on the input drive gear 22 and has the input power applied thereto. The chain 24 is also entrained on a braking gear 28. As will be described in greater detail below, the braking gear 28 is connected to an alternator 30 through a series of pulleys and belts, indicated generally by reference numeral 26. The alternator 30 has a load resistor 32 in its circuit with the electrical output of the alternator 30 being electrically connected by a cable 31 to the load resistor to apply a negative braking power. The braking power is a unidirectional braking force applied to the chain 24 in the direction indicated by arrow D2. It is noted that when following the path of the chain 24, the braking force opposes the exercise force, although with a spatial frame of reference both are in the upward direction along the portions of the chain immediately adjacent the arrows D1 and D2 in FIG. 3.

A feedback loop switches the load on and off of the alternator 30 in such a manner that work done by the alternator is managed in a controlled fashion and work is required to turn the alternator. Thus, a load is selectively put on the alternator 30 and the braking gear 28 so as to maintain the rotational speed of the alternator and the braking velocity of the braking gear, and hence the velocity of the portion of the chain passing by the braking gear, at a selected constant velocity for at least a desired selected portion of the user's exercise time. The load on the alternator 30 is removed and no braking force is applied if the velocity of the braking gear 28 is below the selected constant velocity, and the load on the alternator is applied and the braking force thereby applied if the velocity of the braking gear is above the selected constant velocity. This results in substantially constant velocity of the braking gear 28. As will be described below, this constant velocity may be changed by the user for other portions of the exercise time.

The chain 24 is also entrained on a fixed idler gear 36 located along a first run or length 38 of the chain extending from the braking gear 28 to the input drive gear 22, and on a tensioning idler gear 40 located along a second run or length 42 of the chain extending from the input drive gear 22 to the braking gear 28. The first and second lengths 38 and 42 form the endless loop of the chain 24.

A trolley 44 is suspended by a first trolley idler gear 46 on the first length 38 of the chain 24, riding on a downwardly looping portion of the first length 38 located between the fixed idler gear 36 and the input drive gear 22. The trolley 36 has a second trolley idler gear 48 over which the return second length 42 of the chain 24 extends to form an upwardly looping portion of the second length 42 of the chain 24 located between the tensioning idler gear 40 and the braking gear 28. With this arrangement, slack in the chain 24 is avoided as the trolley 44 moves upward and downward during use of the apparatus 10, as will be described in greater detail below. A spring 50 applies a downward bias to the tensioning idler gear 40 to help maintain a desired tension on the endless loop of the chain 24.

The trolley 44 is operatively connected to a weight 52 by a flexible strap 54. The strap 54 has one end 56 held stationary and another end 58 attached to the weight 52. The strap 54 passes over an idler pulley 60 carried by the trolley 44 as it moves upward and downward. An arrangement of four pulleys 62A, 62B, 62C and 62D are used to connect the strap 54 to the weight 52 to transmit the upward movement of the trolley 44 to the weight 52 and cause lifting of the weight above a rest 64 when the trolley moves upward, and to transmit the downward movement of the trolley to the weight and permit lowering of the weight toward the rest 64 when the trolley moves downward.

The trolley 44 serves as a differential member that effectively has its output coupled to the weight 52, and two inputs coupled to the chain 24 to receive the input power from the input drive gear 22 and the braking power from the braking gear 28 (as discussed above with reference to FIG. 5). The user 12 through the repeated, alternating downward movement of the left and right pedals 18 and 20 uses his legs to input the positive input power with a unidirectional exercise force component. The input velocity component of the input power is translated into rotational drive of the input drive gear 22 in the direction indicated by arrow 66 resulting in a user-selected input velocity component on the chain 24 in the direction of arrow D3. This causes the chain 24 to move past the input drive gear 22 with the user-selected input velocity and the endless loop to circulate in the clockwise direction, as viewed in FIGS. 2 and 3. Each of the left and right pedals 18 and 20 is independently returned to its raised rest position (as shown in FIG. 1) after being moved downward by a return spring assembly 68 formed by multiple springs connected in parallel. As will be described below, only downward movement of the left and right pedals 18 and 20 is used to input the user's input power to the apparatus 10.

The operation of the alternator 30 and the load resister 32 are controlled to generate the negative braking power with a unidirectional drag or braking force component on the chain 24 in the direction of arrow D2 which opposes the exercise force component and with a selected constant braking velocity component in the direction D4. The selected constant braking velocity component of the braking power is translated into rotation of the braking gear 28 at a selected, substantially constant speed in the direction indicated by arrow 34. This causes the chain 24 to move past the braking gear 28 with the selected constant braking velocity and the endless loop to circulate in the clockwise direction, as viewed in FIGS. 2 and 3. In effect, the chain 24 is fed to the trolley 44 at a selected, substantially constant feed rate determined by the rotational speed of the braking gear 28, and the chain is drawn away from the trolley at a draw rate determined by the rotational speed of the input drive gear 22. The result is that trolley 44 acts to determine the differential between the user-selected velocity component and the selected constant braking velocity component, and the resultant is applied to the weight 52 through the strap 54 to lift or lower the weight. Resulting upward movement of the trolley 44 lifts the weight 52, and resulting downward movement of the trolley allows the weight to move downward.

Whether the input drive gear 22 is drawing the chain 24 away from the trolley 44 faster or slower than the speed at which the braking gear 28 is feeding the chain toward the trolley, determines whether the weight is lifted, or the weight is lowered. If the user-selected velocity is greater than the selected constant braking velocity, the weight 52 is lifted, but if the user-selected velocity is less than the selected constant braking velocity, the weight is lowered. If the user-selected velocity exactly matches the selected constant braking velocity, the weight 52 will stay in a suspended position lifted off of the rest 64 for as long as this matched velocity condition is maintained by the user 12.

The preferred operation of the apparatus 10 to achieve the desired substantially controlled load and controlled velocity exercise is for the user 12 to apply sufficient input power through the operation of the left and right pedals 18 and 20 so that the weight 52 will be initially raised to a desired elevated position and then to maintain the weight at that desired elevated position by applying input power with the user-selected velocity substantially matching the selected constant braking velocity. This is accomplished by applying the input power with a velocity selected by the user which causes rotation of the input drive gear 22 to draw the chain 24 away from the trolley 44 at a speed substantially matching the rate the braking gear 28 is feeding the chain toward the trolley. In such manner, the input power is applied with an input velocity substantially matching the selected constant braking velocity.

It is noted that while the user 12 may apply a greater or lesser input power to the apparatus 10, the exercise force component can never be increased or decreased during an exercise from the magnitude that is determined by the mass of the weight 52 selected by the user for the exercise (i.e., the weight setting), and that mass is held constant during each selected portion of the user's exercise time. Only by selecting a different mass for the weight 52 can the exercise force component of the input power be changed. If a greater or lesser input power is applied by the user without changing the mass of the weight 52, only the input velocity component will change, not the exercise force component.

It is also noted that if the user 12 applies an input power to the apparatus 10 with a magnitude appropriate to maintain the weight 52 at the desired elevated position, the input velocity component of the input power will be determined by the constant braking velocity selected by the user for the exercise (i.e., the brake setting), and that braking velocity is held constant during at least a selected portion of the user's exercise time.

Should the user 12 begin to apply a greater input power to the input drive gear 22, as a result of increasing the input velocity component of the input power, the weight 52 will move upward because a differential results, with the speed of the input drive gear 22 and the chain portion it drives being greater than the speed of the braking gear 28 and the chain portion it drives. This is an indicator for the user 12 to reduce the input power to maintain the weight 52 at its new elevation or return the weight to the original elevated position.

On the other hand, should the user decrease the input power being applied to the input drive gear 22, as a result of decreasing the input velocity component of the input power, the weight 52 will move downward because a differential results, with the speed of the input drive gear 22 and the chain portion it drives being less than the speed of the braking gear 28 and the chain portion it drives. This is an indication for the user 12 to increase the input power to maintain the weight 52 at its new elevation or return the weight to the original elevated position.

To maintain the weight at any selected elevational position, the user must attempt to apply an input power through variation of the input velocity component which will substantially match the selected constant braking velocity, thus producing the desired substantially controlled velocity and controlled load exercise. This occurs when the input drive gear 22 draws the chain 24 away from the trolley 44 at the same rate that the braking gear 28 feeds the chain to the trolley.

It is noted that the mass of the weight 52 is effectively simply hung from the trolley 44 and when the input velocity component of the input power matches the selected constant braking velocity component of the braking power, the weight 52 does not move up or down. This is so even though exercise is being conducted at a relatively high input velocity and exercise force. Thus, the problems encountered in the past with exercise machines utilizing a moving weight which produced rapid acceleration and deceleration of the weight during an exercise cycle are substantially eliminated. With the apparatus 10 of the present invention, little movement of the weight 52 is encountered regardless of the input velocity or force selected for the exercise.

The apparatus 10 is constructed using a base frame 70 supporting a left side frame structure 72 and a right side frame structure 74. The left side frame structure 72 has a frame member 76 which has a forwardly positioned vertical lower portion 77 attached to and projecting upward from the base frame 70 and a rearwardly extending upper portion 78. The upper portion 78 supports the cushioned rest 14 against which the user rests the user's back during exercise using the apparatus 10. The handles 16 are fixedly attached to the upper portion 78.

The left side frame structure 72 further includes a rearwardly positioned vertical frame member 80 which extends between the base frame 70 and a rearward end of the upper portion 78 of the frame member 76. A rearwardly inclined frame member 83 is connected between the lower portion 77 of the frame member 76 and an upper end of the vertical frame member 80, below the upper portion 78 of the frame member 76. A horizontal frame member 82 extends between the upper portion 78 of the frame member 76 and the vertical frame member 80.

The left side frame structure 72 serves to support much of the moving components of the apparatus 10. In particular, the idler pulley 36 and the input drive pulley 22 are rotatably mounted on the right side of the horizontal frame member 82. The braking gear 28 is mounted directly below the idler gear 36 to the vertical frame member 80. The tensioning idler gear 40 is positioned directly below the input drive gear 22 and attached to the base frame 70 by a connector mechanism incorporating the tensioning spring 50. The trolley 44 is suspended between these gears on the endless loop of chain 24. The horizontal frame 82 has a stop spring 90 and the base frame 70 has a stop spring 92 in position to be engaged by the upper and lower ends, respectively, of the trolley 44 should the trolley move to the fullest extent possible upward or downward to provide a cushioned stop.

The alternator 30 is mounted to the vertical frame member 80, and, as discussed above, a series of pulleys and belts 26 connects the alternator to the braking gear 28. This series of pulleys and belts 26 are located on the left side of the left side frame structure 72, and includes a large diameter pulley 94 attached on a common shaft with the braking gear 28, and a pair of intermediate pulleys 96 mounted to the vertical frame member 80. A belt is entrained on the pulley 94 and a small diameter pulley comprising one of the pair of intermediate pulleys 96. Another belt is entrained on a large diameter pulley comprising one of the pair of intermediate pulleys 96 and a shaft pulley of the alternator 30. The size of these pulleys is selected to serve as a speed-increasing transmission so that the rotation of the braking gear 28 is transmitted to the alternator 30 with a proper rotational speed for operation of the alternator. The alternator 30 is of conventional design to generate electrical energy in response to turning of its shaft.

The load resister 32 to which the alternator 30 is connected by the cable 31 is located on the left side of the left side frame structure 72, and is mounted to the horizontal frame member 82.

As previously discussed, the positive input power applied by the user 12 through the left and right pedals 18 and 20 is transmitted through the unidirectional clutch 21 to the input drive gear 22. The unidirectional clutch 21 has a shaft 100 rotatably supported by the horizontal frame member 82 with the input drive gear 22 mounted on a right end of the shaft. The clutch shaft 100 extends horizontally to the left and right sides to the horizontal frame member 82, and has a left sprocket 102 mounted on the left end of the clutch shaft and a right sprocket 104 mounted on the right end of the clutch shaft, at a position between the horizontal frame member 82 and the input drive gear 22 (see FIG. 4). Each of the left and right sprockets 102 and 104 includes a unidirectional clutch bearing by which the sprocket is mounted to the clutch shaft 100.

Each of the left and right pedals 18 and 20 includes a foot pad portion 106 on which the user 12 positions one of the user's feet for alternately applying downward force on the left and right foot pedals. Each foot pad 106 is attached to a pedal am 108. The pedal arm 108 for the left pedal 18 is pivotally attached to the inclined frame member 83 on the left side thereof, and the pedal arm 108 for the right pedal 20 is pivotally attached to the inclined frame member on the right side thereof. The pedal arms 108 are pivotally connected to the inclined frame member 83 on opposite ends of a pivot shaft 110.

To transmit the downward force applied by the user 12 on the left and right pedals 18 and 20, each pedal arm 108 has a lever 112 rigidly attached thereto for rotation with the pedal arm about the pivot shaft 110. The free end of each lever 112 has a quarter sprocket 114 fixedly attached thereto. One end of a length of chain 116 is attached to a forward portion of the quarter sprocket 114. The chain 116 for each of the left and right pedals 18 and 20 extends from the corresponding forward portion of the quarter sprocket 114 rearward over the quarter sprocket and is entrained on a corresponding one of the left or right sprocket 102 or 104. The chains 116 pass over the left and right sprockets 102 and 104, and are each attached to an upper end of a corresponding one of the return spring assemblies 68 used to return the left and right pedals 18 and 20 to their raised rest positions shown in FIG. 1- A lower end of each of the return spring assemblies 68 is attached to the base frame 70.

Figure 3:
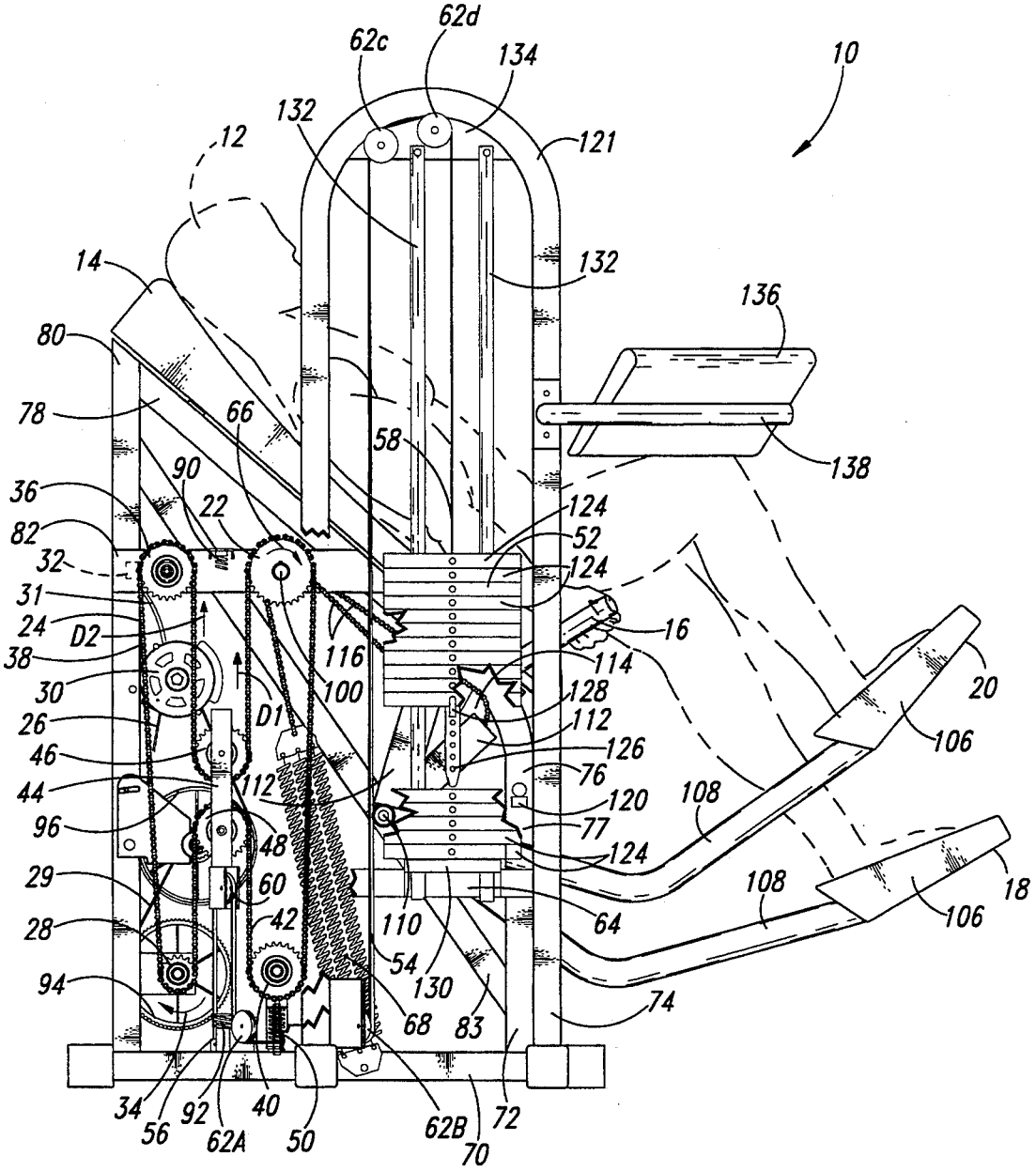
FIG. 3 is a right side, fragmentary, elevational view of the exercise apparatus of FIG. 1 showing a user phantom line exercising to cause a selected portion of the weight stack to be lifted and maintained at a selected height from the rest position.
Figure 4:
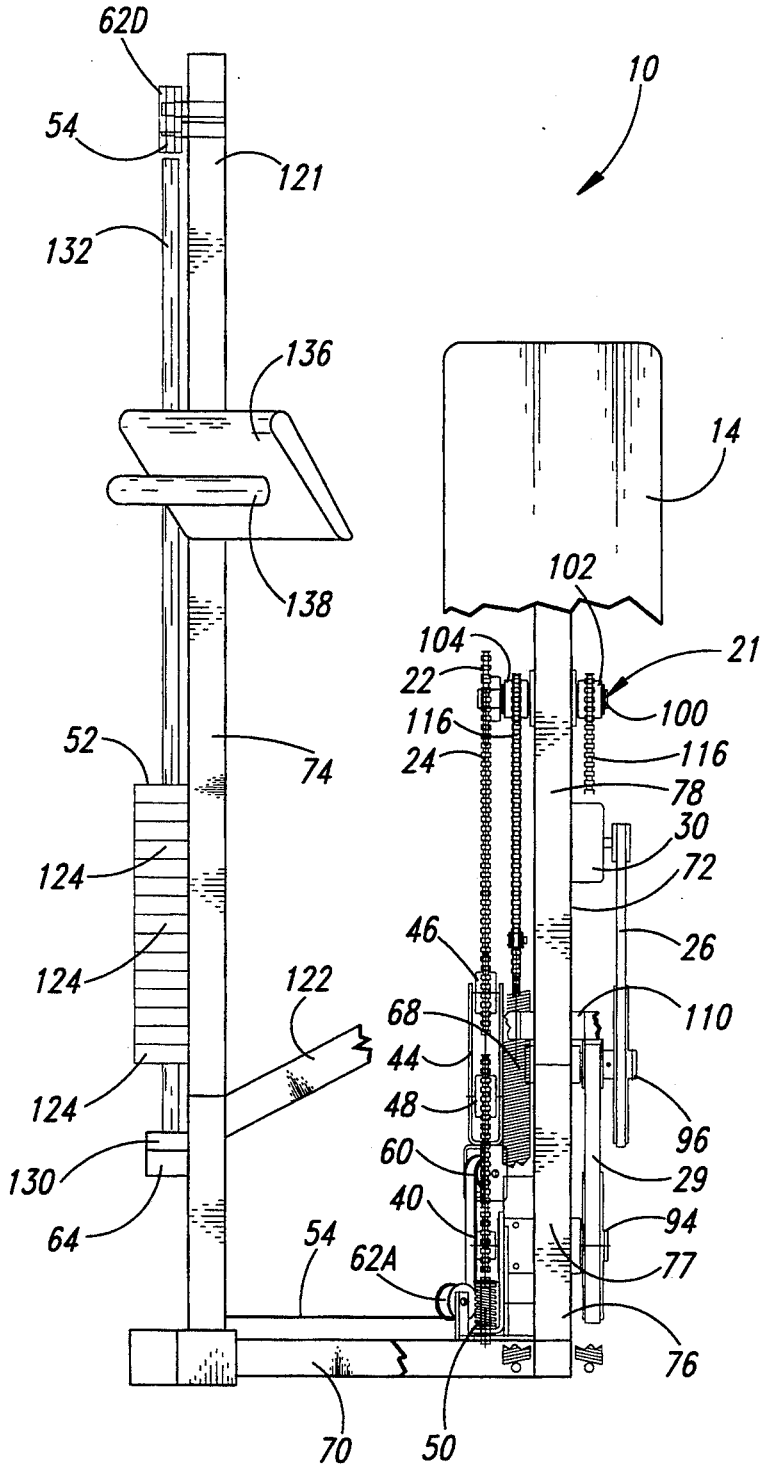
FIG. 4 is an enlarged, fragmentary, front elevational view of the exercise apparatus of FIG. 1.

When the apparatus 10 is not in use, the left and right pedals 18 and 20 are in the raised rest positions shown in FIG. 1. When the user 12 positions himself on the cushioned rest 14 for exercise, such as shown in FIG. 3, the user places one of the user's feet on each of the foot pads 106 of the left and right pedals 18 and 20. The user then alternately applies a downward force to the left and right pedals 18 and 20. Initially, the speed of the braking gear 28 and the alternator 30 connected thereto will be zero, below the selected constant braking velocity for the exercise. Thus, the alternator 30 will initially not apply any braking force to the braking gear 28 and the input power applied by the user 12 will be translated almost completely into increasing the speed with which the chain 24 travels along its endless loop, and little resistance is encountered by the user on the left and right pedals 18 and 20. When the speed of the chain 24, and hence the braking gear 28 on which the chain is entrained, increases to just over the selected constant braking velocity, the alternator 30 will have a load applied to it (with the load being removed only when the velocity drops below the user-selected velocity), thus applying a negative braking power to the chain as necessary to maintain the speed of the braking gear at the selected constant braking velocity. When the braking power is first applied, the weight 52 will begin to lift in the manner described previously until the user 12 adjusts the user-selected velocity of the input power being input to the apparatus 10 through pumping of the left and right pedals 18 and 20. The upward movement of the weight 52 will cease and the weight will remain suspended above the rest 64 at the desired elevation when and for so long as the user-selected velocity is equal to the selected constant braking velocity. If the pedals 18 and 20 are pumped too quickly, the weight 52 will start to rise, and if pumped too slowly, the weight will start to fall.

During operation, the user 12 cannot affect the exercise force component of the input power being applied by operation of the pedals 18 and 20, since this exercise force is held constant and is almost solely a function of the mass selected for the weight 52 to be used for the exercise and which is to be held in the stationary suspended position. Preferably, little upward or downward movement of the weight 52 occurs during the exercise. If the user should increase the input power being applied to the pedals 18 and 20, substantially the only result is increasing the exercise velocity, not the exercise force (the mass of the weight selected primarily determines this exercise force and the mass stays constant throughout the exercise). Thus, the increased input power can only be produced by increased exercise velocity (Power=Force×Velocity), and causes upward movement of the weight 52 until the user readjusts the exercise velocity and hence decreases the input power so that the exercise velocity will again match the selected constant braking velocity and the weight 52 will again assume a stationary elevated position. It is noted that as in any system a power balance must occur, with the input power equaling the braking power. Since the exercise force and the braking force are opposing each other and together balance against the weight/resistance force of the weight 52 to maintain the weight in a stationary suspended state by the trolley 44 riding on the chain 24, the exercise force and the braking force cancel each other (i.e., in the stationary condition $F_{IN} \times V_{IN} = F_{BR} \times V_{BR}$, thus $V_{IN} = V_{BR}$). Any imbalance between the input velocity and the braking velocity will result in an upward or downward velocity of the weight 52.

It is also noted that as long as the weight 52 is elevated above the rest 64, even if the user 12 stops applying input power and the weight is falling, the alternator 30 and hence the braking gear 28 will be regulated to maintain the selected constant braking velocity.

Figure 2:
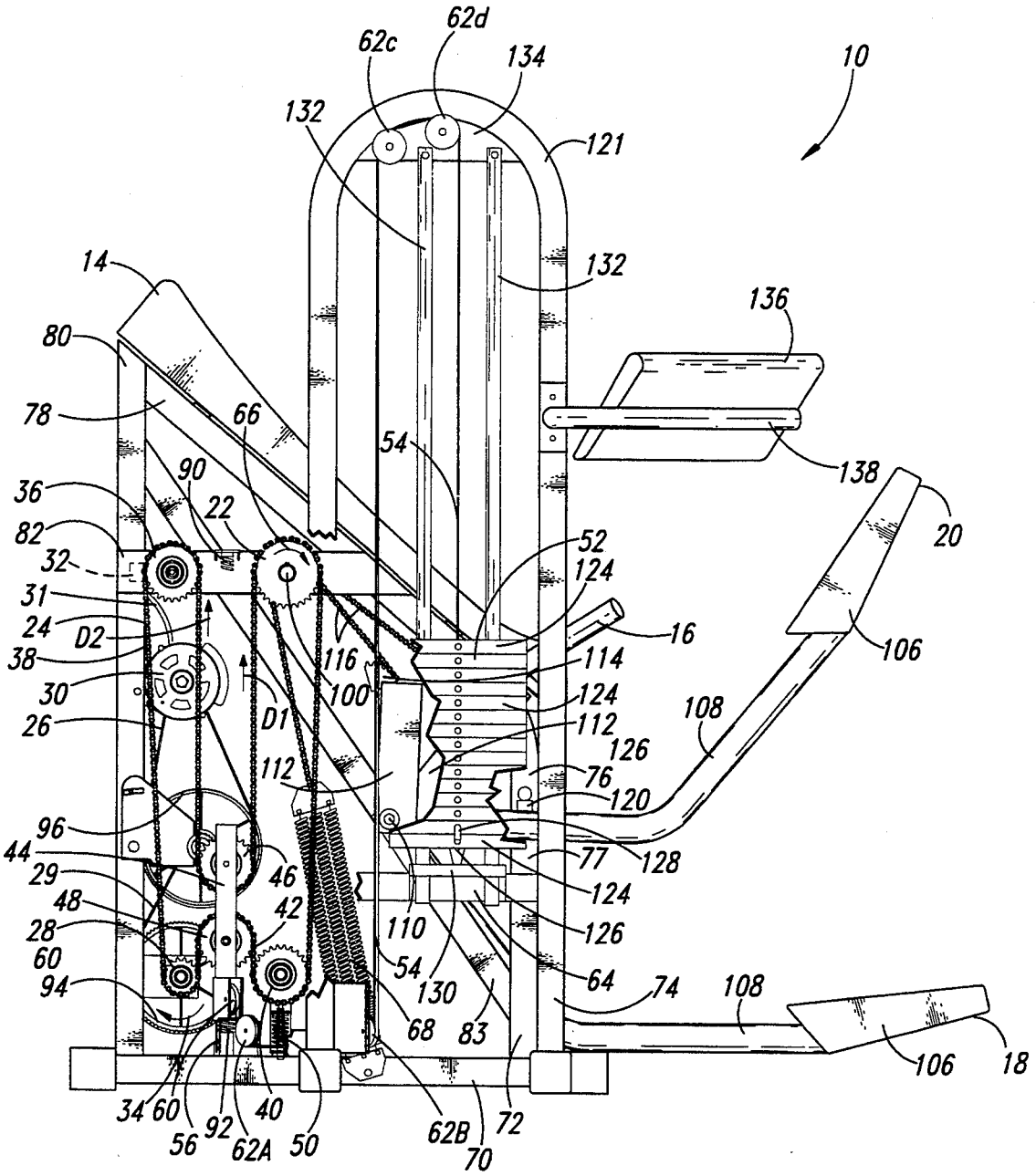
FIG. 2 is a right side, fragmentary, elevational view of the exercise apparatus of FIG. 1 showing a stack of weights with the full stack being slightly lifted from a rest position.

The left and right pedals 18 and 20 are shown in FIG. 2 with the left pedal 18 in the fully downward position and the right pedal 20 in the fully upward position. During exercise, the user 12 moves the pedals downward by the force applied through his feet and the return spring assemblies 68 move the pedals upward. When sufficient downward force is applied to the left and right pedals 18 and 20 by the user 12, the force produces rotation of the pedal arms 108 about the pivot shaft 110 and corresponding rotation of the levers 112 around the pivot shaft. This rotational movement is transmitted by each lever 112 through its corresponding chain 116 to a corresponding one of the left and right sprockets 102 and 104. As previously suggested, the left and right pedals 18 and 20 may operate independently, and could both be pushed down or both allowed to rise at the same time. However, during normal operation a downward force is alternately applied to the left and right pedals.

The rotational movement transmitted by the chains 116 to the left and right sprockets 102 and 104 as a result of the downward travel of the left and right pedals 18 and 20 is converted into clockwise rotation of the clutch shaft 100 by the unidirectional clutch 21. This rotational force is transmitted through the clutch shaft 100 to the input drive gear 22 to provide the input power to the chain 24. It is noted that the return upward movement of the left and right pedals 18 and 20 produces no rotation of the clutch shaft 100 because the clutch bearings positioned between the left and right sprockets 102 and 104 and the clutch shaft allow the sprockets to turn freely on the shaft in the counterclockwise direction when viewed in FIG. 3 without transmitting rotation to the clutch shaft. The clutch bearings only transmit clockwise rotation of the sprockets to the clutch shaft 100.

A cushioned stop 120 is mounted on both the left and right sides of the vertical lower portion 77 of the frame member 76 to cushion the jar that would result should the user quickly remove the user's foot from one or both of the left and right foot pedals 18 and 20 when the pedals are in a lowered position.

The right side frame structure 74 includes an inverted U-shaped frame member 121 fixedly attached to the base frame 70 at a position spaced to the right of the left side frame structure 72. A cross-beam 122 best shown in FIG. 4 extends between the U-shaped frame member 121 and the left side frame structure 72 to provide lateral support. The rest 64 extends between the vertical posts of the U-shaped frame member 121. As previously described, when the weight 52 is in a lowered rest position, the weight rests upon the rest 64.

The weight 52 comprises a stack of individual weights 124 which can be selectively attached together using a lifting rod 126 to vary the size of the weight stack being lifted using a selector pin 128 in a conventional manner. The lifting rod 126 has its upper end attached to the one end 58 of the strap 54, which, as described above, passes over the idler pulley 60 carried by the trolley 44 to cause the weight 52 to be lifted and lowered as the trolley 44 is moved upward and downward, respectively. When the weight 52 is in the rest position on the rest 64, the user 12 may remove the selector pin 128 and reinsert the selector pin through a lateral bore provided in each of the individual weights 124. The selector pin 128 has a sufficient length to extend through the bore in the individual weight and engage a corresponding bore hole in the lifting rod 126. In such manner, all of the individual weights 124 above the individual weight which receives the selector pin 128 will be lifted and lowered as a result of the trolley 44 transmitting its movement through the strap 54 to the lifting rod 126. The individual weights 124 which are located below the individual weight that receives the selector pin 128 will remain at rest on the rest 64. Each of the individual weights 124 has a central aperture through which the selector rod extends.

With use of a selectable weight stack to form the weight 52 to be lifted, the user can select ones of the individual weights 124 to be locked together and thereby select the magnitude of the constant exercise force the user will encounter when exercising using the apparatus 10. It is noted that the adjustment of the weight stack to change the number of the individual weights 124 being lifted, and hence the exercise force is independent of the constant braking velocity selected by the user 12 for the braking force. In the illustrated embodiment of the weight 52, the three uppermost individual weights 124 are permanently locked together and provide a minimum required resistance force.

A resilient cushion 130 is positioned on the rest 64 to cushion the engagement of the weight 52 as it moves downward into contact with the rest, either directly or through however many of the individual weights 124 remain on the rest when the remainder of the weight stack is being lifted. To guide the individual weights 24 as they are moved upward and downward as part of the weight stack, a pair of guide rods 132 are connected between the rest 64 and a_support plate 134 fixedly attached to the upper end portion of the U-shaped frame member 121. A corresponding pair of through holes are provided in each of the individual weights 124 to slideably receive the guide rods 132.

As previously described, the magnitude of the braking force applied by the alternator 30 and the switching of the load to the alternator is controlled by a conventional feedback loop. The selection of the selected constant velocity for the braking velocity of the braking gear 28 is accomplished using a control panel 136 mounted on a support arm 138 attached to the U-shaped frame member 121. The control panel 136 is positioned for easy viewing and manual operation by the user 12 when the user is resting with the user's back against the cushioned rest 14. The control panel 136 is connected to the alternator 30 through a cable (not shown). Circuitry (not shown) is contained within the control panel 136 for presenting a visual display to the user 12 and also providing means for the user to select parameters and options, and input data used by a microprocessor and computer storage means (not shown) mounted within the control panel to run computer-based programs which facilitate operation of the apparatus 10. Conventional circuitry and programming techniques are used.

In addition to allowing the user 12 to select and adjust the magnitude of the selected constant braking velocity of the braking power, the control panel 136 also allows the user the option to select one of a series of pre-programmed exercise programs. The exercise programs each have a pre-stored series of constant braking velocities for the braking power and an associated timing sequence by which the control panel will vary the selected constant braking velocity- In such manner, one selected portion of the user's exercise time will have one selected constant braking velocity and one or more other selected portions of the user's exercise time will have one or more different other selected constant braking velocities according to a predetermined pattern. This produces a more effective exercise sequence. It is noted that these changes only apply to varying the braking velocity component of the braking power and hence the user-selected input velocity component of the input power, since the exercise force component of the input power is determined almost completely by the number of the individual weights 124 selected to make up the weight 52 to be lifted. As such, it should be noted that with the apparatus 10 of the present invention the selected constant braking velocity can be selectively adjusted by the user independent of the mass of the weight 52.

While manual adjustment of the weight 52 by adding or deleting ones of the individual weights 124 is required to adjust the exercise force component, the control panel can provide visual and audible prompts to the user 12 to suggest adding or decreasing the mass of the weight 52 to improve the exercise being conducted.

While the velocities and forces of the input power and braking power have been discussed herein as being constant, the input velocity and force does in fact vary somewhat at the pedals 18 and 20 through the range of motion during a single exercise cycle. These variations result from the particular linkage configurations of the pedal arms 108 and other components selected for the apparatus 10. In fact, it has been determined to be desirable to intentionally vary the velocities and forces somewhat at the pedals 18 and 20 within a single exercise cycle to accommodate the biomechanical strength variations of a user that exist through the range of motion. Nevertheless, the apparatus 10 operates at a constant apparatus velocity and load and produces very constant and reproducible exercise velocity and load from one exercise cycle to the next and at any point in the pedal travel.

Figure 5:
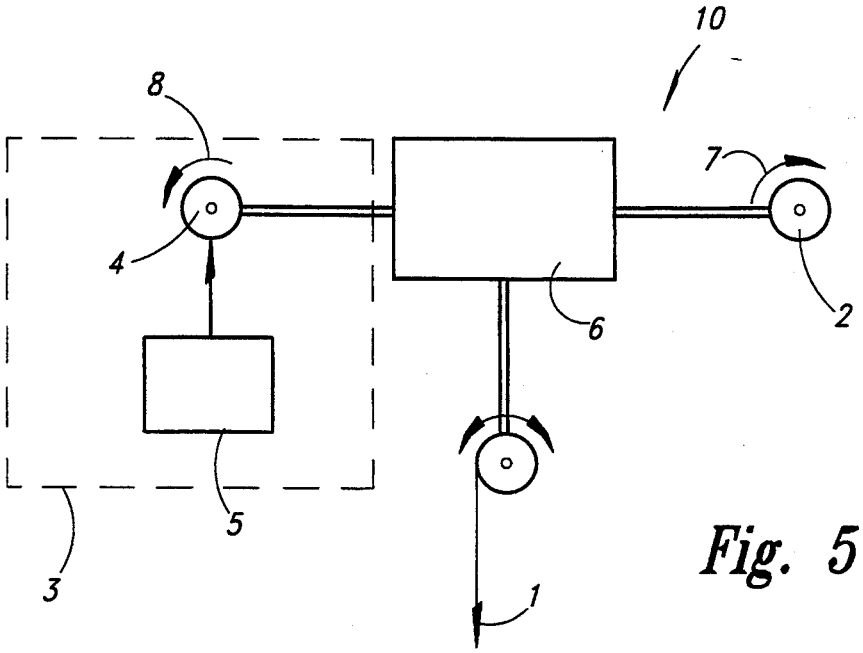
FIG. 5 is a functional block diagram of the exercise apparatus of FIG. 1.

It is noted that while differential 6 shown in FIG. 5 in the illustrated preferred embodiment of the invention uses the trolley 44 suspended on the chain 24, other differentials may be used, such as a conventional differential gear arrangement or a ball screw arrangement. In similar manner, while the resistance force I shown in FIG. 5 takes the form of the weight 52 in the illustrated preferred embodiment of the invention, the resistance force may be supplied by a spring, motor or other resistance member.

It will be appreciated that, although a specific embodiment of the invention has been described herein for purposes of illustration, various modifications may be made without departing from the spirit and scope of the invention. Accordingly, the invention is not limited except as by the appended claims.

We claim:

1. An exercise apparatus, comprising:

a vertically movable weight;

an input mechanism engaged by the user to input a positive input power with a unidirectional exercise force at a user-selected velocity for moving the weight upward;

a brake applying a negative braking power with a unidirectional braking force opposing the exercise force, the braking power having a braking velocity for permitting downward movement of the weight;

a brake controller controlling the application of the brake to maintain the braking velocity at a selected constant velocity for at least a selected portion of the user's exercise time; and a differential member coupled to the weight and receiving the input power from the input mechanism and the braking power from the brake, the differential member determining a differential between the user-selected velocity and the selected constant braking velocity, and applying the resultant to the weight so that if the user-selected velocity is greater than the selected constant braking velocity the weight is lifted, and if the user-selected velocity is less than the selected constant braking velocity the weight is lowered, whereby the user during at least the selected portion of the user's exercise time can apply input power to lift the weight to a desired elevation and maintain the weight at about the desired elevation by applying input power with the user-selected velocity substantially matching the selected constant braking velocity.

2. The apparatus of claim 1, further including a flexible member interconnecting the input mechanism, the brake and the differential member to transmit the input power and the braking power to the differential member.

3. The apparatus of claim 2 wherein the differential member includes a movable trolley with the weight coupled thereto so that movement of the trolley in a first direction lifts the weight and movement of the trolley in a second direction lowers the weight, the trolley being supported by the flexible member to produce movement of the trolley in the first direction if the user-selected velocity is greater than the selected constant braking velocity, and to produce movement of the trolley in the second direction if the user-selected velocity is less than the selected constant braking velocity.

4. The apparatus of claim 3 wherein the flexible member is an endless loop operatively engaged by the brake to transmit the braking power thereto and by the input mechanism to transmit the input power thereto, the flexible member including a first length extending between the brake and the input mechanism, the trolley being suspended on the first length.

5. The apparatus of claim 4 wherein the trolley includes a first idler riding on the flexible member and by which the trolley is suspended on the first length thereof, and a second idler over which a return second length of the flexible member extends, the second length extending between the brake and the input mechanism, whereby slack in the endless loop is avoided as the trolley moves between the first and second directions.

6. The apparatus of claim 1, further including an adjustment member selectively adjustable by the user to select the selected constant braking velocity of the braking power applied by the brake.

7. The apparatus of claim 6 wherein the selected constant braking velocity is selectively adjustable by the user independent of the mass of the weight.

8. The apparatus of claim 6 wherein the weight comprises a stack of individual weights and means for the user to lock selected ones of the individual weights together to form the weight, and wherein the adjustment member allows the user to select the selected constant braking velocity of the braking power applied by the brake independent of the number of the individual weights the user selects to lock together.

9. The apparatus of claim i wherein the weight is a stack of individual weights selectively locked together to permit the user to selectively vary the number of individual weights comprising the weight coupled to the differential member.

10. The apparatus of claim 1 wherein the selected constant braking velocity of the braking power applied by the brake is selectively adjustable during the user's exercise time to vary the selected constant braking velocity during the selected portion of the user's exercise time from the selected constant braking velocity during at least one or more other selected portions of the user's exercise time according to a predetermined pattern.

11. The apparatus of claim 1 wherein the input mechanism includes a pair of pedals operated by the user to input the input power.

12. The apparatus of claim 1, further including an endless loop of chain operatively engaged by the input mechanism and the brake, and operatively engaging the differential member to transmit the input power and the braking power to the differential member.

13. The apparatus of claim 1 wherein the brake includes an alternator operating in conjunction with a load resistor, the rotational speed of the alternator determining the braking velocity of the braking power applied by the brake, and the brake controller includes a feedback loop monitoring the speed of the alternator and controlling the load on the alternator, to control the rotational speed of the alternator.

14. The apparatus of claim 1, further including a flexible member extending between and operatively engaging the brake and the differential member to transmit the braking power therebetween, and extending between and operatively engaging the input mechanism and the differential member to transmit the input power therebetween, and wherein the brake includes a rotatable brake member around which the flexible member is engaged so that the flexible member is fed to the differential member at a constant feed rate by the rotation of the rotatable brake member during at least the selected portion of the user's exercise time and the input mechanism includes a rotatable input member around which the flexible member is engaged so that the flexible member is drawn away from the differential member at a draw rate determined by the rotational speed of the rotatable input member.

15. An exercise apparatus, comprising:

a vertically movable weight;

an input mechanism engaged by the user to input an input power with a unidirectional exercise force at a user-selected velocity for moving the weight upward;

a speed control applying an apparatus controlled power with a unidirectional apparatus force opposing the exercise force, the apparatus controlled power having a selected constant velocity for permitting downward movement of the weight, the speed control applying the apparatus controlled power at the selected constant velocity for at least a selected portion of the user's exercise time; and a differential member coupled to the weight and receiving the input power from the input mechanism and the apparatus controlled power from the speed control, the differential member determining a differential between the user-selected velocity and the selected constant velocity and applying the resultant to the weight so that if the user-selected velocity is greater than the selected constant velocity the weight is lifted, and if the user-selected velocity is less than the selected constant velocity the weight is lowered, whereby the user during at least the selected portion of the user's exercise time can apply input power to lift the weight to a desired elevation and maintain the weight at about the desired elevation by applying input power with the user-selected velocity substantially matching the selected constant velocity.

16. The apparatus of claim 15, further including a flexible member interconnecting the input mechanism, the speed control and the differential member to transmit the input power and the apparatus controlled power to the differential member.

17. The apparatus of claim 16 wherein the differential member includes a movable trolley with the weight coupled thereto so that movement of the trolley in a first direction lifts the weight and movement of the trolley in a second direction lowers the weight, the trolley being supported by the flexible member to produce movement of the trolley in the first direction if the user-selected velocity is greater than the selected constant velocity, and to produce movement of the trolley in the second direction if the user-selected velocity is less than the selected constant velocity.

18. The apparatus of claim 17 wherein the flexible member is an endless loop operatively engaged by the speed control to transmit the apparatus controlled power thereto and by the input mechanism to transmit the input power thereto, the flexible member including a first length extending between the speed control and the input mechanism, the trolley being suspended on the first length.

19. The apparatus of claim 15, further including an adjustment member selectively adjustable by the user to select the selected constant velocity of the apparatus controlled power applied by the speed control.

20. The apparatus of claim 19 wherein the selected constant velocity is selectively adjustable by the user independent of the mass of the weight.

21. The apparatus of claim 19 wherein the weight comprises a stack of individual weights and means for the user to lock selected ones of the individual weights together to form the weight, and wherein the adjustment member allows the user to select the selected constant velocity of the apparatus controlled power applied by the speed control independent of the number of the individual weights the user selects to lock together.

22. The apparatus of claim 15, wherein the weight is a stack of individual weights selectively locked together to permit the user to selectively vary the number of individual weights comprising the weight coupled to the differential member.

23. The apparatus of claim 15 wherein the selected constant velocity of the apparatus controlled power applied by the speed control is selectively adjustable during the user's exercise time to vary the selected constant velocity during the selected portion of the user's exercise time from the selected constant velocity during at least one or more other selected portions of the user's exercise time according to a predetermined pattern.

24. The apparatus of claim 15, further including a flexible member extending between and operatively engaging the speed control and the differential member to transmit the apparatus controlled power therebetween, and extending between and operatively engaging the input mechanism and the differential member to transmit the input power therebetween, and wherein the speed control includes a rotatable control member around which the flexible member is engaged so that the flexible member is fed to the differential member at a constant feed rate by the rotation of the rotatable control member during at least the selected portion of the user's exercise time and the input mechanism includes a rotatable input member around which the flexible member is engaged so that the flexible member is drawn away from the differential member at a draw rate determined by the rotational speed of the rotatable input member.

25. An exercise apparatus, comprising:

a connector member;

a vertically movable weight coupled to the connector member;

an endless loop of a flexible member;

an input mechanism engaged by the user to input an input power with a unidirectional exercise force at a user-selected velocity, the input power being applied to the flexible member at an input position along the endless loop for moving the connector member upward and thereby lifting the weight;

a speed control applying an apparatus controlled power with a unidirectional apparatus force opposing the exercise force, the apparatus controlled power having a selected constant velocity, the apparatus controlled power being applied to the flexible member at a speed control position along the endless loop to limit the speed of the flexible member at the speed control position for permitting downward movement of the connector member and thereby permitting lowering of the weight, the speed control applying the apparatus controlled power at the selected constant velocity for at least a selected portion of the user's exercise time; and a differential member coupled to the connector member and being supported by engaging a first length of the flexible member as it extends between the input position and the speed control position, the flexible member transmitting the input power from the input mechanism to the differential member and the apparatus controlled power from the speed control to the differential member determining a differential between the user-selected velocity and the selected constant velocity, and applying the resultant to the connector member so that if the user-selected velocity is greater than the selected constant velocity the weight is lifted, and if the user-selected velocity is less than the selected constant velocity the weight is lowered, whereby the user during at least the selected portion of the user's exercise time can apply input power to lift the weight to a desired elevation and maintain the weight at about the desired elevation by applying input power with the user-selected velocity substantially matching the selected constant velocity.

26. The apparatus of claim 25 wherein the differential member includes a movable trolley coupled to the weight through the connector member so that movement of the trolley in a first direction lifts the weight and movement of the trolley in a second direction lowers the weight, the trolley being supported by the flexible member to produce movement of the trolley in the first direction if the user-selected velocity is greater than the selected constant velocity, and to produce movement of the trolley in the second direction if the user-selected velocity is less than the selected constant velocity.

27. The apparatus of claim 26 wherein the trolley includes a first idler riding on the flexible member and by which the trolley is supported on the first length thereof, and a second idler over which a return second length of the flexible member extends, the second length extending between the input position and the speed control position, whereby slack in the endless loop is avoided as the trolley moves between the first and second directions.

28. The apparatus of claim 25, further including an adjustment member selectively adjustable by the user to select the selected constant velocity of the apparatus controlled power applied by the brake.

29. The apparatus of claim 28 wherein the selected constant velocity is selectively adjustable by the user independent of the mass of the weight.

30. The apparatus of claim 28 wherein the weight comprises a stack of individual weights and means for the user to lock selected ones of the individual weights together to form the weight, and wherein the adjustment member allows the user to select the selected constant velocity of the apparatus controlled power applied by the speed control independent of the number of the individual weights the user selects to lock together.

31. The apparatus of claim 25 wherein the weight is a stack of individual weights selectively locked together to permit the user to selectively vary the number of individual weights comprising the weight coupled to the differential member.

32. The apparatus of claim 25 wherein the selected constant velocity of the apparatus controlled power applied by the speed control is selectively adjustable during the user's exercise time to vary the selected constant velocity during the selected portion of the user's exercise time from the selected constant velocity during at least one or more other selected portions of the user's exercise time according to a predetermined pattern.

33. An exercise apparatus, comprising:

a connector member;

a resistance member applying a resistance force to the connector member in a first direction;

an input mechanism engaged by the user to input a positive input power with a unidirectional exercise force at a user-selected velocity for moving the connector member in a second direction generally opposite the first direction;

a brake applying a negative braking power with a unidirectional braking force opposing the exercise force, the braking power having a braking velocity for permitting movement of the connector member in the first direction;

a brake controller controlling the application of the brake to maintain the braking velocity at a selected constant velocity for at least a selected portion of the user's exercise time; and a differential member coupled to the connector member and receiving the input power from the input mechanism and the braking power from the brake, the differential member determining a differential between the user-selected velocity and the selected constant braking velocity, and applying the resultant to the connector member so that if the user-selected velocity is greater than the selected constant braking velocity the connector member is moved in the second direction, and if the user-selected velocity is less than the selected constant braking velocity the connector member is moved in the first direction.

34. The apparatus of claim 33 further including a flexible member interconnecting the input mechanism, the brake and the differential member to transmit the input power and the braking power to the differential member.

35. The apparatus of claim 34 wherein the differential member includes a movable trolley coupled to the resistance member though the connector member, the trolley being engaged by the flexible member to produce movement of the trolley in one direction if the user-selected velocity is greater than the braking velocity, and to produce movement of the trolley in an opposite direction if the user-selected velocity is less than the selected constant braking.

36. The apparatus of claim 35, wherein the flexible member is an endless loop operatively engaged by the brake to transmit the braking power thereto and by the input mechanism to transmit the input power thereto, the flexible member including a first length extending between the brake and the input mechanism, the trolley being suspended on the first length.

37. The apparatus of claim 36 wherein the trolley includes a first idler riding on the flexible member and by which the trolley is suspended on the first length thereof.

38. The apparatus of claim 33, further including an adjustment member selectively adjustable by the user to select the selected constant braking velocity of the braking power applied by the brake.

39. The apparatus of claim 38 wherein the resistance member includes means for the user to selectively vary the magnitude of the resistance force, and wherein the adjustment member allows the user to select the selected constant braking velocity of the braking power applied by the brake independent of the magnitude the user selects for the resistance force.

40. The apparatus of claim 33 wherein the resistance member is selectively variable by the user to selectively vary the magnitude of the resistance force.

41. The apparatus of claim 33 wherein the selected constant braking velocity of the braking power applied by the brake is selectively adjustable during the user's exercise time to vary the selected constant braking velocity during the selected portion of the user's exercise time from the selected constant braking velocity during at least one or more other selected portions of the user's exercise time according to a predetermined pattern.

42. The apparatus of claim 33 wherein the brake includes an alternator operating in conjunction with a load resistor, the rotational speed of the alternator determining the braking velocity of the braking power applied by the brake, and the brake controller includes a feedback loop monitoring the speed of the alternator and controlling the load on the alternator, to control the rotational speed of the alternator.

43. The apparatus of claim 33, further including a flexible member extending between and operatively engaging the brake and the differential member to transmit the braking power therebetween, and extending between and operatively engaging the input mechanism and the differential member to transmit the input power therebetween, and wherein the brake includes a rotatable brake member around which the flexible member is engaged so that the flexible member is fed to the differential member at a constant feed rate by the rotation of the rotatable brake member during at least the selected portion of the user's exercise time and the input mechanism includes a rotatable input member around which the flexible member is engaged so that the flexible member is drawn away from the differential member at a draw rate determined by the rotational speed of the rotatable input member.

44. An exercise apparatus, comprising:

a movable resistance member applying a resistance force;

an input mechanism engaged by the user to input a positive input power with a unidirectional exercise force at a user-selected velocity, the exercise force being determined by the resistance force;

a brake applying a negative braking power with a unidirectional braking force opposing the exercise force, the braking power having a braking velocity, the braking force being determined by the resistance force, with the combined exercise force and braking force being in balance with the resistance force;

a brake controller controlling the application of the brake to maintain the braking velocity at a selected constant velocity for at least a selected portion of the user's exercise time; and a differential member coupled to the resistance member and receiving the input power from the input mechanism and the braking power from the brake, the differential member determining a differential between the user-selected velocity and the selected constant braking velocity, and applying the resultant to the resistance member so that if the user-selected velocity is greater than the selected constant braking velocity the resistance member is moved in a first direction, and if the user-selected velocity is less than the selected constant braking velocity the resistance member is moved in a second direction.

45. The apparatus of claim 44 further including a flexible member interconnecting the input mechanism, the brake and the differential member to transmit the input power and the braking power to the differential member.

46. The apparatus of claim 45 wherein the differential member includes a movable trolley coupled to the resistance member, the trolley being engaged by the flexible member to produce movement of the trolley in one direction if the user-selected velocity is greater than the braking velocity, and to produce movement of the trolley in another direction if the user-selected velocity is less than the selected constant braking velocity.

47. The apparatus of claim 44, further including an adjustment member selectively adjustable by the user to select the selected constant braking velocity of the braking power applied by the brake.

48. The apparatus of claim 47 wherein the resistance member includes means for the user to selectively vary the magnitude of the resistance force, and wherein the adjustment member allows the user to select the selected constant braking velocity of the braking power applied by the brake independent of the magnitude the user selects for the resistance force.

49. The apparatus of claim 44 wherein the resistance member is selectively variable by the user to selectively vary the magnitude of the resistance force 50. The apparatus of claim 44, further including a flexible member extending between and operatively engaging the brake and the differential member to transmit the braking power therebetween, and extending between and operatively engaging the input mechanism and the differential member to transmit the input power therebetween, and wherein the brake includes a rotatable brake member around which the flexible member is engaged so that the flexible member is fed to the differential member at a constant feed rate by the rotation of the rotatable brake member during at least the selected portion of the user's exercise time and the input mechanism includes a rotatable input member around which the flexible member is engaged so that the flexible member is drawn away from the differential member at a draw rate determined by the rotational speed of the rotatable input member.

51. An exercise apparatus, comprising:

a movable resistance member applying a resistance force;

an input mechanism engaged by the user to input an input power with a unidirectional exercise force at a user-selected velocity, the exercise force being determined by the resistance force;

a speed control applying an apparatus-controlled power with a unidirectional apparatus force opposing the exercise force, the apparatus-controlled power having a selected constant velocity, the apparatus force being determined by the resistance force, with the combined exercise force and apparatus force being in balance with the resistance force, the speed control applying the apparatus-controlled power at the selected constant velocity for at least a selected portion of the user's exercise time; and a differential member coupled to the resistance member and receiving the input power from the input mechanism and the apparatus-controlled power from the speed control, the differential member determining a differential between the user-selected velocity and the selected constant velocity, and applying the resultant to the resistance member so that if the user-selected velocity is greater than the selected constant velocity the resistance member is moved in a first direction, and if the user-selected velocity is less than the selected constant velocity the resistance member is moved in a second direction.

52. The apparatus of claim 51 further including a flexible member interconnecting the input mechanism, the speed control and the differential member to transmit the input power and the apparatus-controlled power to the differential member.

53. The apparatus of claim 51 wherein the speed control includes a brake.

54. The apparatus of claim 2 wherein the flexible member has first, second and third lengthwise portions, the first portion of the flexible member extending between the brake and the input mechanism, the differential member including a first rotatable member suspended on the first portion of the flexible member for lifting and lowering vertical movement of the first rotatable member in response to shortening and lengthening of the first portion of the flexible member, the weight being coupled to the first rotatable member for vertical movement therewith, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the second and third rotatable members.

55. The apparatus of claim 54 wherein the flexible member further includes a fourth lengthwise portion extending between the second and third portions of the flexible member such that the flexible member forms an endless loop.

56. The apparatus of claim 2 wherein the flexible member has first, second and third lengthwise portions, the first portion of the flexible member extending between the brake and the input mechanism, the differential member including a rotatable member suspended on the first portion of the flexible member for lifting and lowering vertical movement of the first rotatable member in response to shortening and lengthening of the first portion of the flexible member, the weight being coupled to the first rotatable member for vertical movement therewith, the brake applying the negative braking power to the second portion of the flexible member, and the input mechanism applying the positive input power to the third portion of the flexible member.

57. The apparatus of claim 16 wherein the flexible member has first, second and third lengthwise portions, the first portion of the flexible member extending between the speed control and the input mechanism, the differential member including a first rotatable member suspended on the first portion of the flexible member for lifting and lowering vertical movement of the first rotatable member in response to shortening and lengthening of the first portion of the flexible member, the weight being coupled to the first rotatable member for vertical movement therewith, the speed control including a second rotatable member around which the second portion of the flexible member is engaged with the apparatus-controlled power being applied to the second portion of the flexible member, and the input mechanism including a third rotatable member around which the third portion of the flexible member is engaged with the input power being applied to the third portion of the flexible member, the flexible member transmitting the input power and the apparatus-controlled power to the differential member while being moved in a unidirection along a path of movement between the second and third rotatable members.

58. The apparatus of claim 57 wherein the flexible member further includes a fourth lengthwise portion extending between the second and third portions of the flexible member such that the flexible member forms an endless loop.

59. The apparatus of claim 16 wherein the flexible member has first, second and third lengthwise portions, the first portion of the flexible member extending between the speed control and the input mechanism, the differential member including a rotatable member suspended on the first portion of the flexible member for lifting and lowering vertical movement of the first rotatable member in response to shortening and lengthening of the first portion of the flexible member, the weight being coupled to the first rotatable member for vertical movement therewith, the speed control applying the apparatus-controlled power to the second portion of the flexible member, and the input mechanism applying the input power to the third portion of the flexible member.

60. The apparatus of claim 25 wherein the differential member includes a first rotatable member around which the first length of the flexible member is engaged for reciprocal movement of the first rotatable member in response of shortening and lengthening of the first length of the flexible member, the connector member being coupled to the first rotatable member for movement therewith, the speed control including a second rotatable member positioned at the speed control position and around which the first length of the flexible member is engaged with the apparatus-controlled power being applied to the first length of the flexible member by the second rotatable member, and the input mechanism including a third rotatable member positioned at the input position and around which the first length of the flexible member is engaged with the input power being applied to the first length of the flexible member by the third rotatable member, the flexible member transmitting the input power and the apparatus-controlled power to the differential member while being moved in a unidirection along a path of movement between the second and third rotatable members.

61. The apparatus of claim 25 wherein the differential member includes a rotatable member around which the first length of the flexible member is engaged for reciprocal movement of the first rotatable member in response to shortening and lengthening of the first length of the flexible member, the connector member being coupled to the first rotatable member for movement therewith.

62. The apparatus of claim 34 wherein the flexible member has first, second and third lengthwise portions, the first portion of the flexible member extending between the brake and the input mechanism, the differential member including a first rotatable member around which the first portion of the flexible member is engaged for reciprocal movement of the first rotatable member in response to shortening and lengthening of the first portion of the flexible member, the connector member being coupled to the first rotatable member for movement therewith, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the second and third rotatable members.

63. The apparatus of claim 62 wherein the flexible member further includes a fourth lengthwise portion extending between the second and third portions of the flexible member such that the flexible member forms an endless loop.

64. The apparatus of claim 34 wherein the flexible member has first, second and third lengthwise portions, the first portion of the flexible member extending between the brake and the input mechanism, the differential member including a rotatable member around which the first portion of the flexible member is engaged for reciprocal movement of the first rotatable member in response to shortening and lengthening of the first portion of the flexible member, the connector member being coupled to the first rotatable member for movement therewith, the brake applying the negative braking power to the second portion of the flexible member, and the input mechanism applying the positive input power to the third portion of the flexible member.

65. The apparatus of claim 45 wherein the flexible member has first, second and third lengthwise portions, the first portion of he flexible member extending between he brake and the input mechanism, the differential member including a first rotatable member around which the first portion of the flexible member is engaged for reciprocal movement of the first rotatable member in response to shortening and lengthening of the first portion of the flexible member, the resistance member being coupled to the first rotatable member for movement therewith, the brake including a second rotatable member around which the second portion of the flexible member is engaged with the negative braking power being applied to the second portion of the flexible member, and the input mechanism including a third rotatable member around which the portion of the flexible member is engaged with the positive power being applied to the third portion of the flexible member, the flexible member a transmitting the positive input power and the negative braking power to the differential member while being moved in a unidirection along a path of movement between the second and third rotatable members.

66. The apparatus of claim 65 wherein the flexible member further includes a_fourth lengthwise portion extending between the second and third portions of the flexible member such that the flexible member forms an endless loop.

67. The apparatus of claim 45 wherein the flexible member has first, second and third lengthwise portions, the first portion of the flexible member extending between the brake and the input mechanism, the differential member including a rotatable member around which the first portion of the flexible member is engaged for reciprocal movement of the first rotatable member in response to shortening and lengthening of the first portion of the flexible member, the resistance member being coupled to the first rotatable member for movement therewith, the brake applying the negative braking power to the second portion of the flexible member, and the input mechanism applying the positive input power to the third portion of the flexible member.

68. The apparatus of claim 52 wherein the flexible member has first, second and third lengthwise portions, the first portion of the flexible member extending between the speed control and the input mechanism, the differential member including a first rotatable member around which the first portion of the flexible member is engaged for reciprocal movement of the first rotatable member in response to shortening and lengthening of the first portion of the flexible member, the resistance member being coupledto the first rotatable member for movement therewith, the speed control including a second rotatable member around which the second portion of the flexible member is engaged with the apparatus-controlled power being applied to the second portion of the flexible member, and the input mechanism including a third rotatable member around which the third portion of the flexible member is engaged with the input power being applied to the third portion of the flexible member, the flexible member transmitting the input power and the apparatus-controlled power to the differential member while being moved in a unidirection along a path of movement between the second and third rotatable members.

69. The apparatus of claim 68 wherein the flexible member further includes a fourth lengthwise portion extending between the second and third portions of the flexible member such that the flexible member forms an endless loop.

70. The apparatus of claim 52 wherein the flexible member has first, second and third lengthwise portions, the first portion of the flexible member extending between the speed control and the input mechanism, the differential member including a rotatable member around which the first portion of the flexible member is engaged for reciprocal movement of the first rotatable member in response to shortening and lengthening of the first portion of the flexible member, the resistance member being coupled to the first rotatable member for movement therewith, the speed control applying the apparatus-controlled power to the second portion of the flexible member, and the input mechanism applying the input power to the third portion of the flexible member.

* * * * *

UNITED STATES PATENT AND TRADEMARK OFFICE

CERTIFICATE OF CORRECTION

PATENT NO. : 5,354,248
DATED : October 11, 1994
INVENTOR(S) : R. Lee Rawls and James A. Duncan It is certified that error appears in the above-indentified patent and that said Letters Patent is hereby corrected as shown below:

In column 14, claim 9, line 38, please delete "i" and insert therefor --1--.

In column 17, claim 25, line 15, after "member" and before "determining", please insert --, the differential member--.

In column 22, claim 60, line 46, before "shortening" and after "response" please delete "pans" and insert therefor --to--.

In column 23, claim 65, lines 49 & 50, please delete "he" and insert therefor --the--.

In column 23, claim 65, line 65, please delete "a".

In column 24, claim 68, line 33, please delete "coupledto" and insert therefor --coupled to--.

Signed and Sealed this
Twentieth Day of February, 1996

Bruce Lehman

BRUCE LEHMAN
*Commissioner of Patents and Trademarks*

*Attest:*

*Attesting Officer*